US010252349B2

(12) United States Patent
Cuenca et al.

(10) Patent No.: US 10,252,349 B2
(45) Date of Patent: Apr. 9, 2019

(54) FORWARD GRIP SYSTEM

(71) Applicants: Jojo De Vera Cuenca, San Francisco, CA (US); Joel Asuncion Dionisio, Daly City, CA (US)

(72) Inventors: Jojo De Vera Cuenca, San Francisco, CA (US); Joel Asuncion Dionisio, Daly City, CA (US)

( * ) Notice: Subject to any disclaimer, the term of this patent is extended or adjusted under 35 U.S.C. 154(b) by 4 days.

(21) Appl. No.: 15/599,488

(22) Filed: May 19, 2017

(65) Prior Publication Data

US 2018/0335274 A1 Nov. 22, 2018

(51) Int. Cl.

| | |
|---|---|
| ***B23B 31/20*** | (2006.01) |
| ***F41A 23/06*** | (2006.01) |
| ***F41C 23/16*** | (2006.01) |

(52) U.S. Cl.

CPC ..... *B23B 31/20* (2013.01); *F41A 23/06* (2013.01); *F41C 23/16* (2013.01); *Y10T 279/17299* (2015.01); *Y10T 279/17435* (2015.01)

(58) Field of Classification Search

CPC ..... B23B 31/20; F41A 23/06; F41C 23/16; Y10T 279/17299; Y10T 279/17435; Y10T 279/17504; Y10T 403/5706; Y10T 403/5753

See application file for complete search history.

(56) References Cited

U.S. PATENT DOCUMENTS

| | | | | | |
|---|---|---|---|---|---|
| 78,225 | A * | 5/1868 | Merriman | F16G 11/12 | 403/44 |
| 445,192 | A * | 1/1891 | Nye et al. | F41C 23/16 | 42/71.01 |
| 575,109 | A * | 1/1897 | Gulick | B62K 21/12 | 74/551.1 |
| 789,499 | A * | 5/1905 | Lightholder | F16B 7/182 | 279/42 |
| 1,058,482 | A * | 4/1913 | Spurgeon | F16B 7/0413 | 279/42 |
| 1,140,978 | A * | 5/1915 | Hart | H01R 4/5025 | 279/42 |
| 1,626,176 | A * | 4/1927 | Atwood | G01B 5/08 | 279/42 |
| 2,423,434 | A * | 7/1947 | Beaupre | F16M 11/14 | 248/694 |
| 3,164,920 | A * | 1/1965 | Haas, Jr. | F41C 23/16 | 42/71.01 |

(Continued)

*Primary Examiner* — Eric A Gates
(74) *Attorney, Agent, or Firm* — Patential; Keum Park

(57) ABSTRACT

A forward grip system is disclosed for supporting a paintball gun. The forward grip system has an inner, longer, hollow cylindrical body with threaded sections with two conical ends with slits around them. The middle section of the inner, longer, hollow cylindrical body has a groove for the outer, shorter, hollow cylindrical body to rotate around on. The edges of the grooved middle section of the inner, longer, hollow cylindrical body are raised to secure the outer, shorter, hollow cylindrical body within the grooved middle section as it rotates around the inner, longer, hollow cylindrical body. A vertical shaft is connected onto the outer, shorter, hollow cylindrical body to function as the handle. There are two threaded locking collars for engaging each of the threaded sections of the inner, longer, hollow cylindrical body for the purpose of locking the forward grip system in place onto a paintball barrel.

13 Claims, 5 Drawing Sheets

(56) References Cited

U.S. PATENT DOCUMENTS

| | | | | | |
|---|---|---|---|---|---|
| 3,495,844 | A * | 2/1970 | Dee | A61C 1/144 | 279/137 |
| 3,623,257 | A * | 11/1971 | Ray | F41C 23/16 | 42/71.01 |
| 4,421,443 | A * | 12/1983 | Woythal | B23B 31/201 | 279/48 |
| 6,397,507 | B1 * | 6/2002 | Marshall | F41C 23/16 | 42/106 |
| 6,920,713 | B1 * | 7/2005 | Love | F41A 23/04 | 42/90 |
| 7,121,034 | B2 | 10/2006 | Keng | | |
| 7,454,858 | B2 * | 11/2008 | Griffin | F41C 23/16 | 42/71.01 |
| 7,578,089 | B1 | 8/2009 | Griffin | | |
| 7,676,975 | B2 * | 3/2010 | Phillips | F41C 23/14 | 42/72 |
| 7,937,875 | B1 * | 5/2011 | Berg | F41C 23/16 | 42/71.01 |
| 8,176,669 | B1 * | 5/2012 | Griffin | F41C 23/14 | 42/90 |
| 8,950,387 | B2 * | 2/2015 | Stevens | F41B 11/70 | 124/56 |
| 8,984,789 | B2 | 3/2015 | Adcock | | |
| 2016/0153743 | A1 * | 6/2016 | Hawkins | F41C 23/12 | 42/71.01 |

* cited by examiner

FORWARD GRIP SYSTEM

CROSS REFERENCE TO RELATED APPLICATIONS

Not Applicable

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention generally relates to forward grip devices, and more particularly to a forward grip system for a paintball gun that attaches to the barrel of a paintball gun.

2. Description of Related Arts

The following related arts have shown different configurations of forward grips or forward handles: U.S. Pat. No. 7,578,089 B1 is a weapon grip assembly for attachment to a forward portion of a weapon which includes a base assembly with a handle and clamps adapted for securing to the forward portion of the weapon; U.S. Pat. No. 8,984,789 B2 is a foregrip for a firearm that comprise a mounting device to be attached to a mounting rail of a firearm; U.S. Pat. No. 7,121,034 B2 is a grip and bipod mounting device for mounting a bipod supporting grip assembly to a "picatinny" mounting rail structure as are often affixed below the forearm stock of a firearm.

Related arts teach various forward grips for supporting an actual weapon or firearms, however, the related arts do not teach a forward grip device that easily slides over the barrel of any paintball marker that locks into place by turning two threaded locking collars, and the forward grip or forward handle can rotate around the paintball gun barrel.

The present invention provides an improved, simple, and easy to use device that can be used to support a paintball gun by attaching it to the paintball gun barrel.

BRIEF SUMMARY OF THE INVENTION

The present invention is a forward grip system that can support a paintball gun by attaching the forward grip system onto the barrel of the paintball gun.

In one embodiment, a forward grip system is disclosed, featuring: a) an inner, longer hollow, cylindrical body with threaded sections, b) an outer, shorter, hollow cylindrical body that envelopes the middle section of the inner hollow cylindrical body with threaded sections, c) a vertical support shaft, and d) two threaded locking collars for engaging the two threaded sections of the inner, hollow cylindrical body.

Other aspects and objects of the present invention will become apparent from the following detailed description of the invention as illustrated in the accompanying drawings and appended claims.

BRIEF DESCRIPTION OF THE SEVERAL VIEWS OF THE DRAWINGS

The present invention may be more readily described with reference to the accompanying drawings, in which.

Similar reference characters denote corresponding features consistently throughout the accompanying drawings.

DETAILED DESCRIPTION OF THE INVENTION

Figure 1:
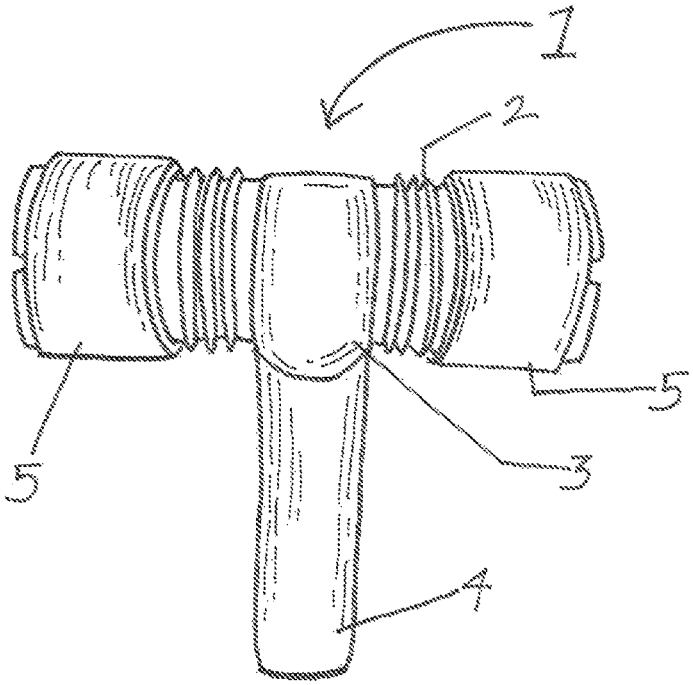
FIG. 1 is a perspective side view of the forward grip system.
Figure 2:
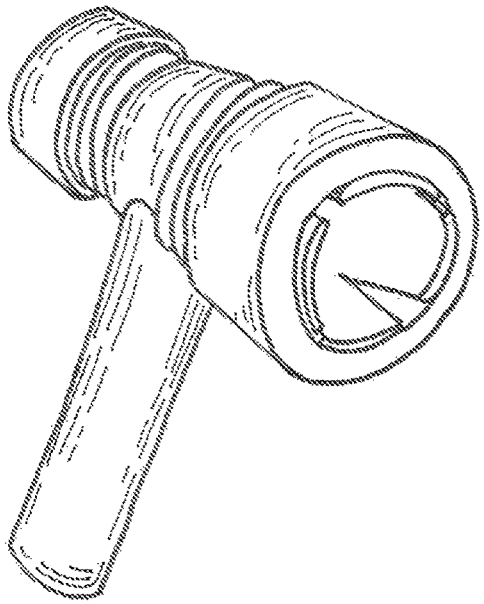
FIG. 2 is a perspective diagonal view of the forward grip system.

As shown in the embodiment of FIG. 1, a forward grip system in accordance with the present invention is shown at 1. The forward grip system 1 comprises: a) an inner, longer, hollow cylindrical body with threaded sections 2, b) an outer, shorter, hollow cylindrical body 3, c) a vertical support shaft 4, and d) two threaded locking collars 5.

Figure 3:
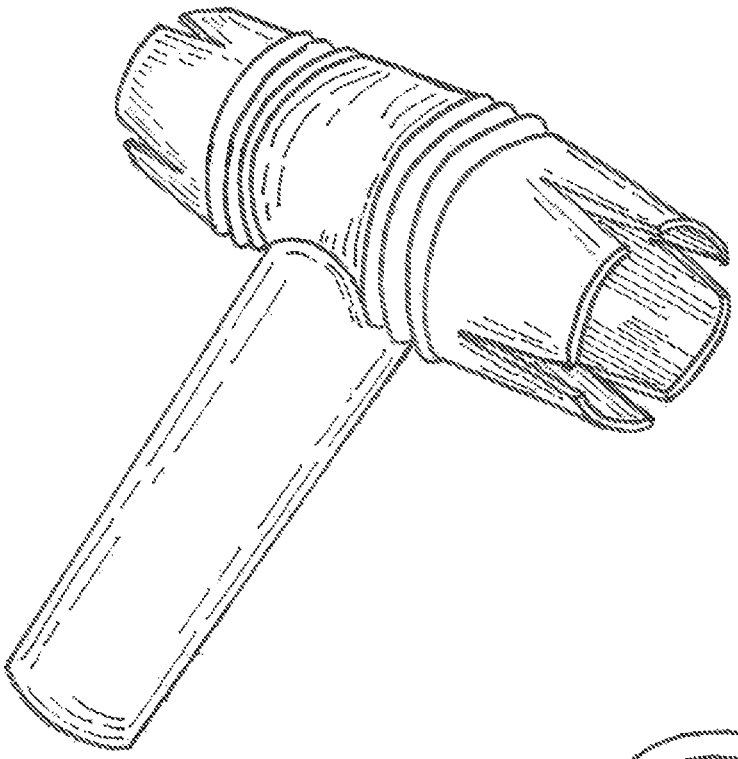
FIG. 3 is a perspective diagonal view of the forward grip system with both threaded locking collars detached.
Figure 4:
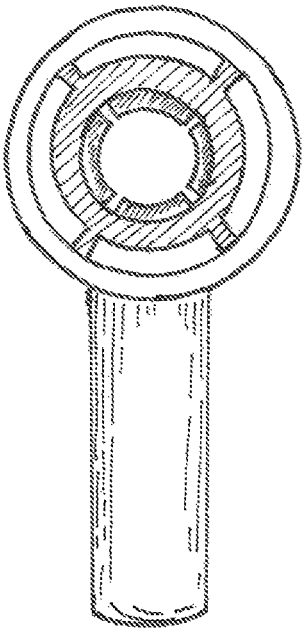
FIG. 4 is a perspective frontal view of the forward grip system with the threaded locking collars attached.

Referring to FIG. 3, the inner, longer, hollow cylindrical body with threaded sections 2 has two conical shaped ends. The conical shape is applied only to the exterior body of the conical shaped ends, thereby maintaining a fixed diameter of opening throughout the entire length of the inner, longer, hollow cylindrical body with threaded sections 2. Starting from both openings of the conical shaped ends, the materials are thinner in width to becoming thicker in width toward the threaded sections.

Referring to FIG. 3, the inner, longer, hollow cylindrical body with threaded sections 2 has a grooved middle section for the outer, shorter, hollow cylindrical body 3 to rotate around on.

Referring to FIG. 3, on each end of the grooved middle section has a raised edge to secure the outer, shorter, hollow cylindrical body 3 in place while rotating around the grooved middle section of the inner, longer, hollow cylindrical body 2 with threaded sections.

Referring to FIG. 3, the threaded sections of the inner, longer, hollow cylindrical body 2 with threaded sections are positioned on each outer end of the grooved middle section.

Referring to FIG. 3, the two conical shaped ends of the inner, longer, hollow cylindrical body 2 with threaded sections have slits around them.

Figure 5:
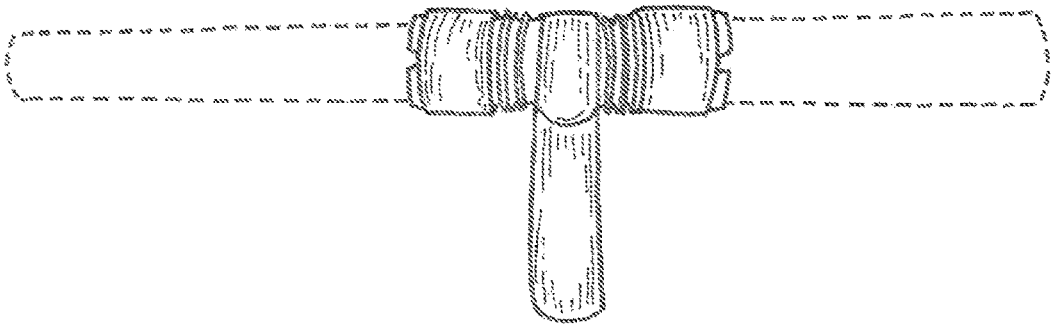
FIG. 5 is a perspective side view of the forward grip system attached onto a paintball barrel with both threaded locking collars attached.
Figure 6:
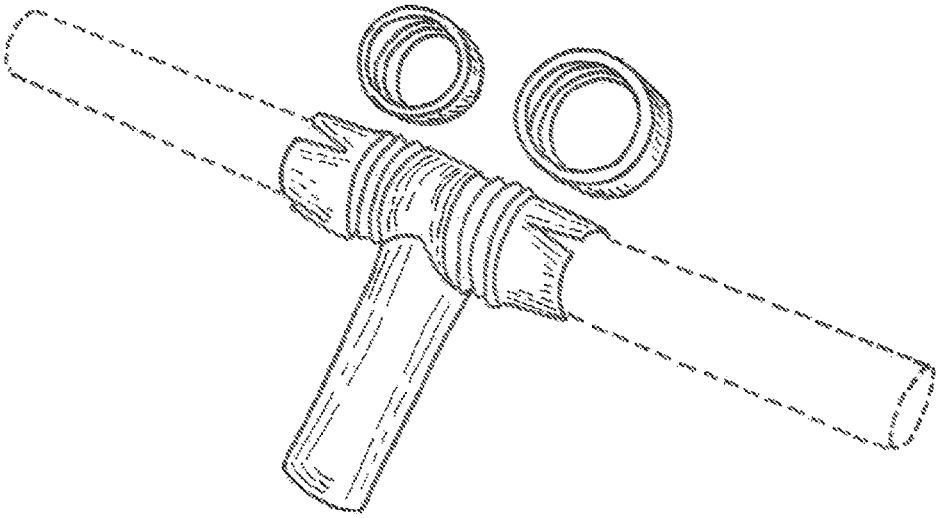
FIG. 6 is a perspective diagonal view of the forward grip system attached onto a paintball barrel with both threaded locking collars detached.

Referring to FIG. 5, as the two threaded locking collars 5 rotate inward around the threaded sections, the two threaded locking collars begin to push down around the conical shaped ends, thereby gripping the paintball barrel, locking the forward grip system in place onto the paintball barrel.

Referring to FIG. 1, one end of the vertical support shaft 4 is connected to the outer, shorter, hollow cylindrical body 3.

Figure 7:
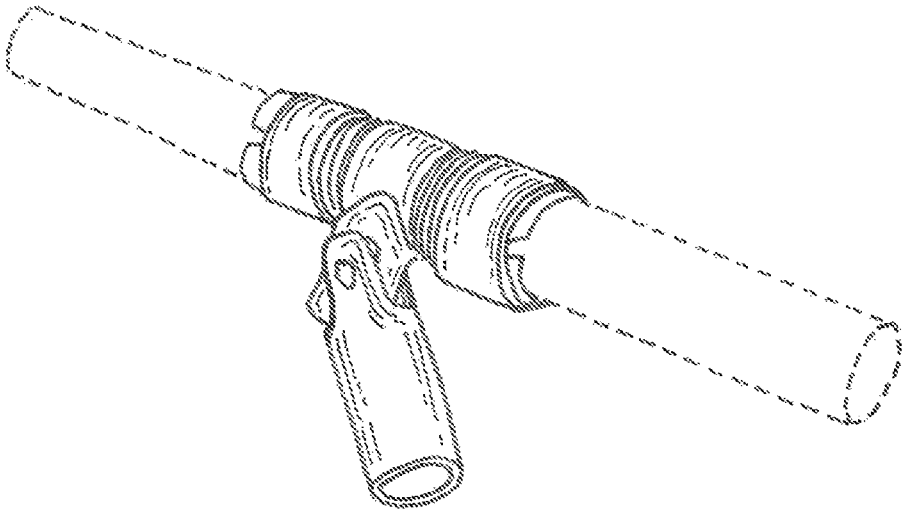
FIG. 7 is a perspective diagonal view of the forward grip system with an optional moveable handle attached onto a paintball barrel with both threaded locking collars attached.
Figure 8:
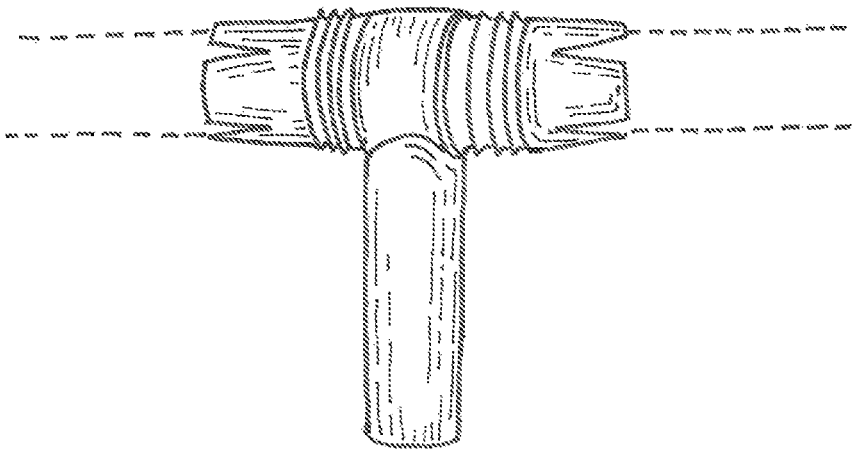
FIG. 8 is a perspective side view of the forward grip system attached onto a paintball barrel without the threaded locking collars.
Figure 9:
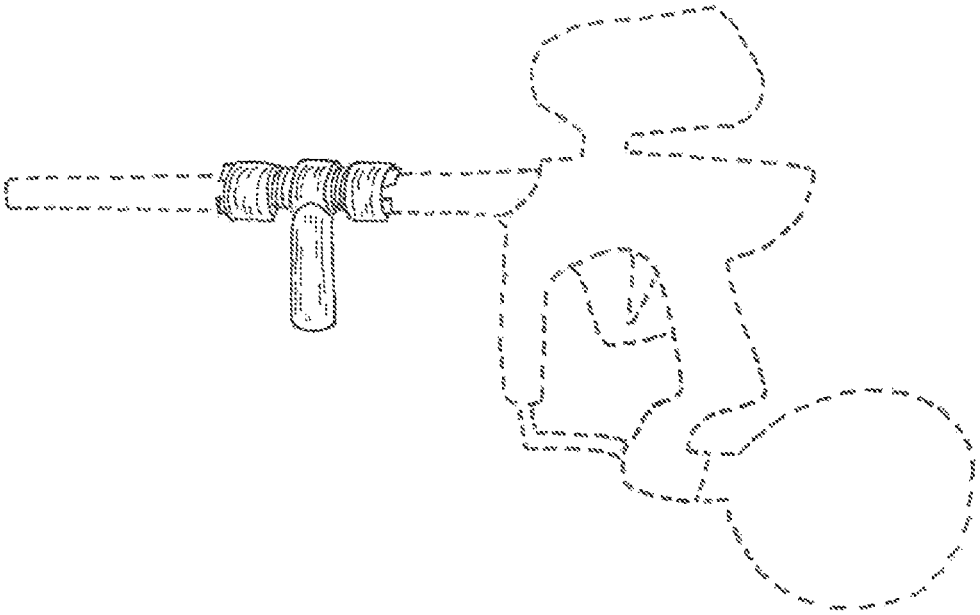
FIG. 9 is a perspective side view of the forward grip system attached onto a paintball barrel connected to a paintball gun.

Referring to FIG. 7, the vertical support shaft 4, which functions as the handle or grip, can either be fixed or moveable for the purpose of ease and convenience for the user's desired hand position.

We claim:

1. A forward grip system for supporting a paintball gun comprising:

an inner, hollow cylindrical body member adapted to substantially hold a paintball gun barrel, said inner, hollow cylindrical body member having two round apertures for fitting about a paintball gun barrel;

an outer, hollow cylindrical body member adapted to envelope the inner, longer, hollow cylindrical body member, wherein said inner, hollow cylindrical body member is longer in length than said outer, hollow cylindrical body member;

a vertical shaft member having an upper end and a lower end, said vertical shaft member attached by said upper end portion to said outer, hollow, cylindrical body member; and two threaded locking collar members adapted to engage threaded sections of said inner, hollow cylindrical body member.

2. A forward grip system as recited in claim 1, wherein said vertical shaft member is secured to said outer, hollow cylindrical body member by epoxy resin.

3. A forward grip system as recited in claim 1, wherein said inner, hollow, cylindrical body member, said outer, hollow cylindrical body member, said vertical shaft member, and two threaded locking collar members are formed from rigid thermoplastic material.

4. A forward grip system as recited in claim 1, wherein said inner, hollow cylindrical body member has two conical shaped ends; said two conical shaped ends have horizontal slits around them.

5. A forward grip system as recited in claim 1, wherein said inner, hollow cylindrical body member has a grooved middle section, said grooved middle section has raised edges, said raised edges securing the rotation of said, outer, hollow cylindrical body member around said inner, hollow cylindrical body member.

6. A forward grip system as recited in claim 1, wherein said inner, hollow cylindrical body member has threaded sections on each side of grooved middle section.

7. A forward grip system as recited in claim 1, wherein said inner, hollow cylindrical body member has two conical shaped ends, wherein said conical shape is applied only to exterior body of said two conical shaped ends, a fixed diameter of aperture is maintained throughout the entire length of said inner, hollow cylindrical body member, and starting from both openings, the exterior body of said conical shaped ends are thinner in width to becoming thicker in width toward the threaded sections of said inner, hollow cylindrical body member.

8. A forward grip system as recited in claim 1, wherein said outer, hollow cylindrical body member envelopes the grooved middle section of said inner, hollow cylindrical body member.

9. A forward grip system as recited in claim 1, wherein said vertical shaft member comprises a rubber grip.

10. A forward grip system as recited in claim 1, wherein said vertical shaft member has imprinted granulated texture.

11. A forward grip system as recited in claim 1, wherein said vertical shaft member has an upper pivot point so as to have a moveable said vertical shaft member.

12. A forward grip system as recited in claim 1, wherein said two threaded locking collar members has imprinted granulated texture all around the exterior of said two threaded locking collar members for ease of gripping.

13. A forward grip system as recited in claim 1, wherein said two threaded locking collar members have tapered threads.

* * * * *